US009438983B2

(12) United States Patent
Chang et al.

(10) Patent No.: US 9,438,983 B2
(45) Date of Patent: Sep. 6, 2016

(54) SIGNAL PROCESSING CIRCUIT AND ASSOCIATED SIGNAL PROCESSING METHOD APPLIED TO HEADSET

(71) Applicant: Realtek Semiconductor Corp., HsinChu (TW)

(72) Inventors: Cheng-Pin Chang, Taipei (TW); Yi-Chang Tu, New Taipei (TW); Tsung-Peng Chuang, Hsinchu County (TW); Sheng-Nan Chiu, Hsinchu (TW)

(73) Assignee: Realtek Semiconductor Corp., HsinChu (TW)

( * ) Notice: Subject to any disclaimer, the term of this patent is extended or adjusted under 35 U.S.C. 154(b) by 106 days.

(21) Appl. No.: 14/509,060

(22) Filed: Oct. 8, 2014

(65) Prior Publication Data

US 2015/0139437 A1 May 21, 2015

(30) Foreign Application Priority Data

Nov. 20, 2013 (TW) ..... 102142300 A

(51) Int. Cl.
*H04R 1/10* (2006.01)
*H04R 5/04* (2006.01)
*H04R 3/12* (2006.01)

(52) U.S. Cl.
CPC ..... *H04R 1/1041* (2013.01); *H04R 3/12* (2013.01); *H04R 5/04* (2013.01); *H04R 2203/00* (2013.01); *H04R 2420/09* (2013.01); *H04R 2460/01* (2013.01)

(58) Field of Classification Search
None
See application file for complete search history.

(56) References Cited

U.S. PATENT DOCUMENTS

2001/0053228 A1* 12/2001 Jones ..... G10K 11/1788 381/71.6
2012/0155668 A1* 6/2012 Kam ..... H04R 1/1083 381/71.6
2013/0089208 A1* 4/2013 Fairey ..... H04R 5/04 381/17
2013/0266146 A1* 10/2013 Miao ..... H04R 1/1041 381/28

FOREIGN PATENT DOCUMENTS

TW 200814466 3/2008
TW 201201198 A1 1/2012

* cited by examiner

*Primary Examiner* — Andrew L Sniezek
(74) *Attorney, Agent, or Firm* — Winston Hsu; Scott Margo

(57) ABSTRACT

The present invention provides a signal processing circuit and a signal processing method applied to a headset. In the present invention, the signal processing circuit adjusts gain and phase of a left channel signal and a right channel signal to generate a first adjust signal, and a recorded sound from a microphone is added by the first adjust signal to cancel a coupled signal. In addition, the signal processing circuit adjusts gain and phase of the right channel signal to generate a second adjust signal, and the right channel signal is added by the second adjust signal to cancel a coupled signal; and the signal processing circuit adjusts gain and phase of the left channel signal to generate a third adjust signal, and the left channel signal is added by the third adjust signal to cancel a coupled signal.

12 Claims, 4 Drawing Sheets

SIGNAL PROCESSING CIRCUIT AND ASSOCIATED SIGNAL PROCESSING METHOD APPLIED TO HEADSET

BACKGROUND OF THE INVENTION

1. Field of the Invention

The present invention relates to signal processing, and more particularly, to a signal processing circuit and a signal processing method applied to a headset.

2. Description of the Prior Art

Regarding a related art headset, when the plug of the headset is inserted into an audio jack and the headset plays audio signals with both the left and right earphones, a user's right ear may hear the sound of the left channel, and the user's left ear may hear the sound of the right channel due to the impedance of the grounding point of the audio jack, the impedance of the inner grounding point of the audio integrated circuit (IC), or the impedance of the layout trace for connecting the audio jack to the audio IC. Further, if the microphone of the headset is recording sounds at the same time, the microphone will record the sounds of the left channel and the right channel simultaneously. The above crosstalk interference degrades user's experience of using the headset.

SUMMARY OF THE INVENTION

Hence, one objective of the present invention is to provide a signal processing circuit and a signal processing method applied to a headset to reduce the aforementioned crosstalk, thereby solving the issue of the related art.

According to an embodiment of the present invention, a signal processing circuit applied to a headset is provided. The headset includes a left earphone, a right earphone and a microphone. The signal processing circuit receives a sound signal from the microphone, and generates audio signals to the left earphone and the right earphone, respectively. The signal processing circuit includes an analog-to-digital converter, an audio processing circuit, a first gain and phase adjuster and a first adder. The analog-to-digital converter is arranged for receiving the sound signal from the microphone, and converting the sound signal into a digital input signal. The audio processing circuit is arranged for generating a left channel signal and a right channel signal, wherein the left channel signal and the right channel signal are utilized to generate the audio signals. The first gain and phase adjuster is coupled to the audio processing circuit, and arranged to adjust gains and phases of the left channel signal and the right channel signal to generate a first adjusted signal. The first adder is coupled to the analog-to-digital converter, the first gain and phase adjuster and the audio processing circuit, and the first adder is arranged to combine the digital input signal and the first adjusted signal to generate an adjusted digital input signal to the audio processing circuit.

According to another embodiment of the present invention, a signal processing circuit applied to a headset is provided. The headset includes a left earphone, a right earphone and a microphone. The signal processing circuit receives a sound signal from the microphone, and generates audio signals to the left earphone and the right earphone, respectively. The signal processing circuit includes an audio processing circuit, a first gain and phase adjuster, a first adder, a first analog-to-digital converter, a second gain and phase adjuster, a second adder, and a second analog-to-digital converter. The audio processing circuit is arranged for generating a left channel signal and a right channel signal. The first gain and phase adjuster is coupled to the audio processing circuit, and arranged to adjust a gain and a phase of the right channel signal to generate a first adjusted signal. The first adder is coupled to the first gain and phase adjuster and the audio processing circuit, and the first adder is arranged to combine the left channel signal and the first adjusted signal to generate an adjusted left channel signal. The first analog-to-digital converter is coupled to the first adder, and arranged to perform an analog-to-digital conversion upon the adjusted left channel signal to generate a left channel audio signal in the audio signals. The second gain and phase adjuster is coupled to the audio processing circuit, and arranged to adjust a gain and a phase of the left channel signal to generate a second adjusted signal. The second adder is coupled to the second gain and phase adjuster and the audio processing circuit, and the second adder is arranged to combine the right channel signal and the second adjusted signal to generate an adjusted right channel signal. The second analog-to-digital converter is coupled to the second adder, and the second analog-to-digital converter is arranged to perform an analog-to-digital conversion upon the adjusted right channel signal to generate a right channel audio signal in the audio signals.

According to another embodiment of the present invention, a signal processing method applied to a headset is provided. The headset includes a left earphone, a right earphone and a microphone. The signal processing method includes: receiving a sound signal from the microphone, and converting the sound signal into a digital input signal; generating a left channel signal and a right channel signal, wherein the left channel signal and the right channel signal are utilized to generate audio signals outputted to the left earphone and the right earphone, respectively; adjusting gains and phases of the left channel signal and the right channel signal, to generate a first adjusted signal; and combining the digital input signal and the first adjusted signal, to generate an adjusted digital input signal.

According to another embodiment of the present invention, a signal processing method applied to a headset is provided. The headset includes a left earphone, a right earphone and a microphone. The signal processing method includes: generating a left channel signal and a right channel signal; adjusting a gain and a phase of the right channel signal, to generate a first adjusted signal; combining the left channel signal and the first adjusted signal, to generate an adjusted left channel signal; performing an analog-to-digital conversion upon the left channel signal, to generate a left channel audio signal to the left earphone; adjusting a gain and a phase of the left channel signal, to generate a second adjusted signal; combining the right channel signal and the second adjusted signal, to generate an adjusted right channel signal; and performing an analog-to-digital conversion upon the right channel signal, to generate a right channel audio signal to the right earphone.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
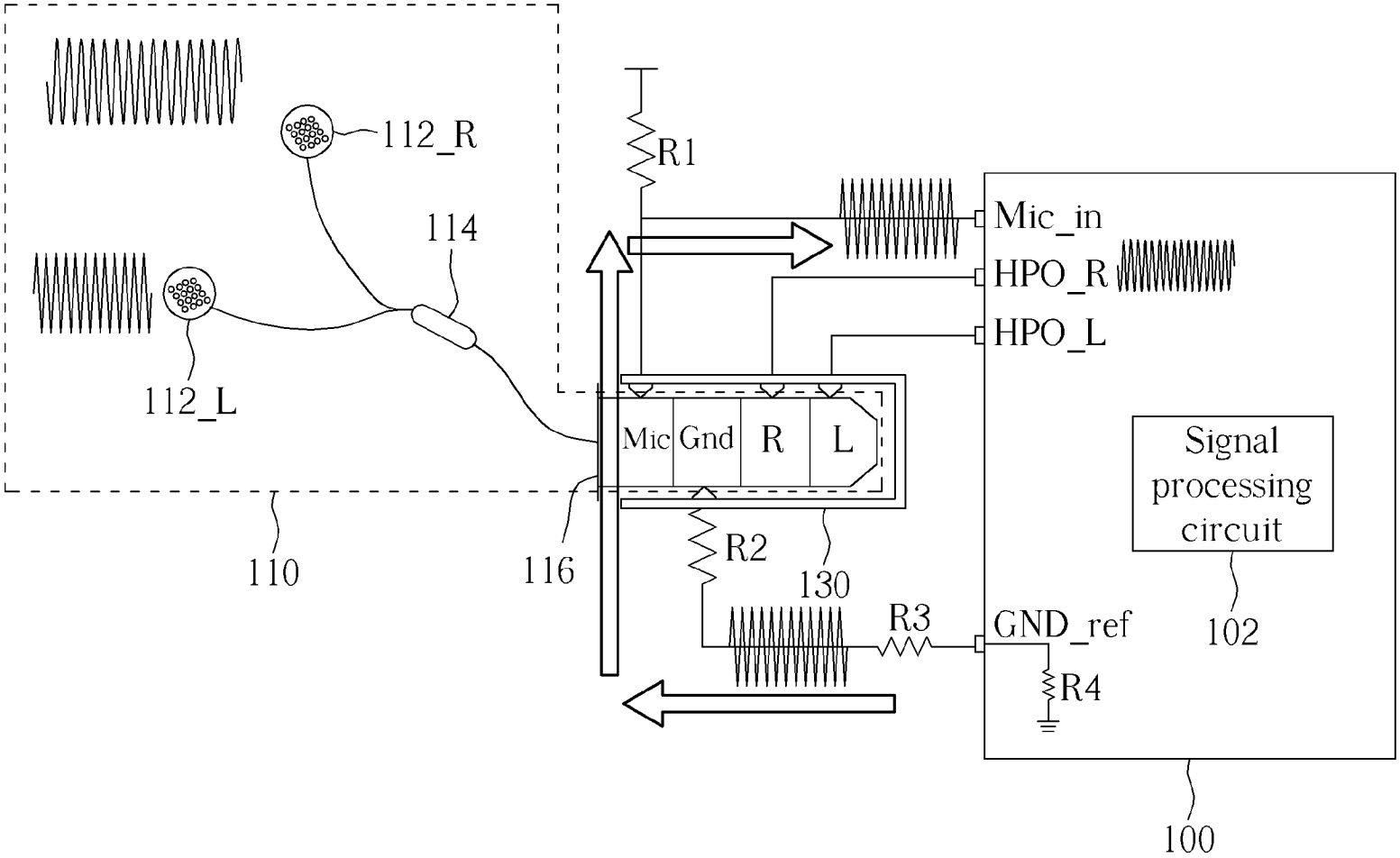
FIG. 1 is a diagram illustrating an overall structure of a signal processing circuit applied to a headset according to an embodiment of the present invention.

Please refer to FIG. 1, which is a diagram illustrating an overall structure of a signal processing circuit 102 applied to a headset 110 according to an embodiment of the present invention. As shown in FIG. 1, the signal processing circuit 102 is manufactured in a chip 100. The chip 100 includes at least four connection points Mic_in, HPO_R, HPO_L and GND_ref connected to four different terminals of a sound jack 130 through layout traces, respectively. Besides, the headset 110 includes a right earphone 112_R, a left earphone 112_L, a microphone 114 and an audio plug 116, wherein the audio plug 116 mainly includes four connection points Mic, Gnd, R and L.

When the audio plug 116 is connected to the audio jack 130 and the chip 100 starts operating, sounds recorded by the microphone 114 will be transmitted to the signal processing circuit 102 through the connection point Mic on the audio plug 116 and the connection point Mic_in on the chip 100 (the element R1 show in FIG. 1 is a resistor), a left channel audio signal generated by the signal processing circuit 102 will be transmitted to the left earphone 112_L through the connection point HPO_L on the chip 100 and the connection point L on the audio plug 116, and a right channel audio signal generated by the signal processing circuit 102 will be transmitted to the right earphone 112_R through the connection point HPO_R on the chip 100 and the connection point R on the audio plug 116.

Further, as shown in FIG. 1, since the connection point Gnd (i.e., the grounding point) on the audio plug 116 is connected to the connection point GND_ref (i.e., the reference grounding point) on the chip 100 through a layout trace, the existence of the impedance R2 of the connection point Gnd, the impedance R3 of the layout trace and the impedance R4 of the inner grounding point of the chip 100 makes the grounding voltage value become unstable, which causes the left channel audio signal of the left earphone 112_L and the right channel audio signal of the right earphone 112_R to be coupled to other signal line(s). For example, referring to FIG. 1, when the chip 100 outputs right channel audio signals from the connection point HPO_R, part of the right channel audio signals will be coupled to the layout trace between the connection point Gnd and the connection point GND_ref, and then these coupling signals will be transmitted to the left earphone 112_L and the connection point Mic_in of the chip 100. Consequently, the user hears the right channel audio signals from the left earphone 112_L. Further, the sounds recorded by the microphone 114 will be mixed with these coupling signals, thus deteriorating the sound recording quality as well as the sound playback quality.

Figure 2:
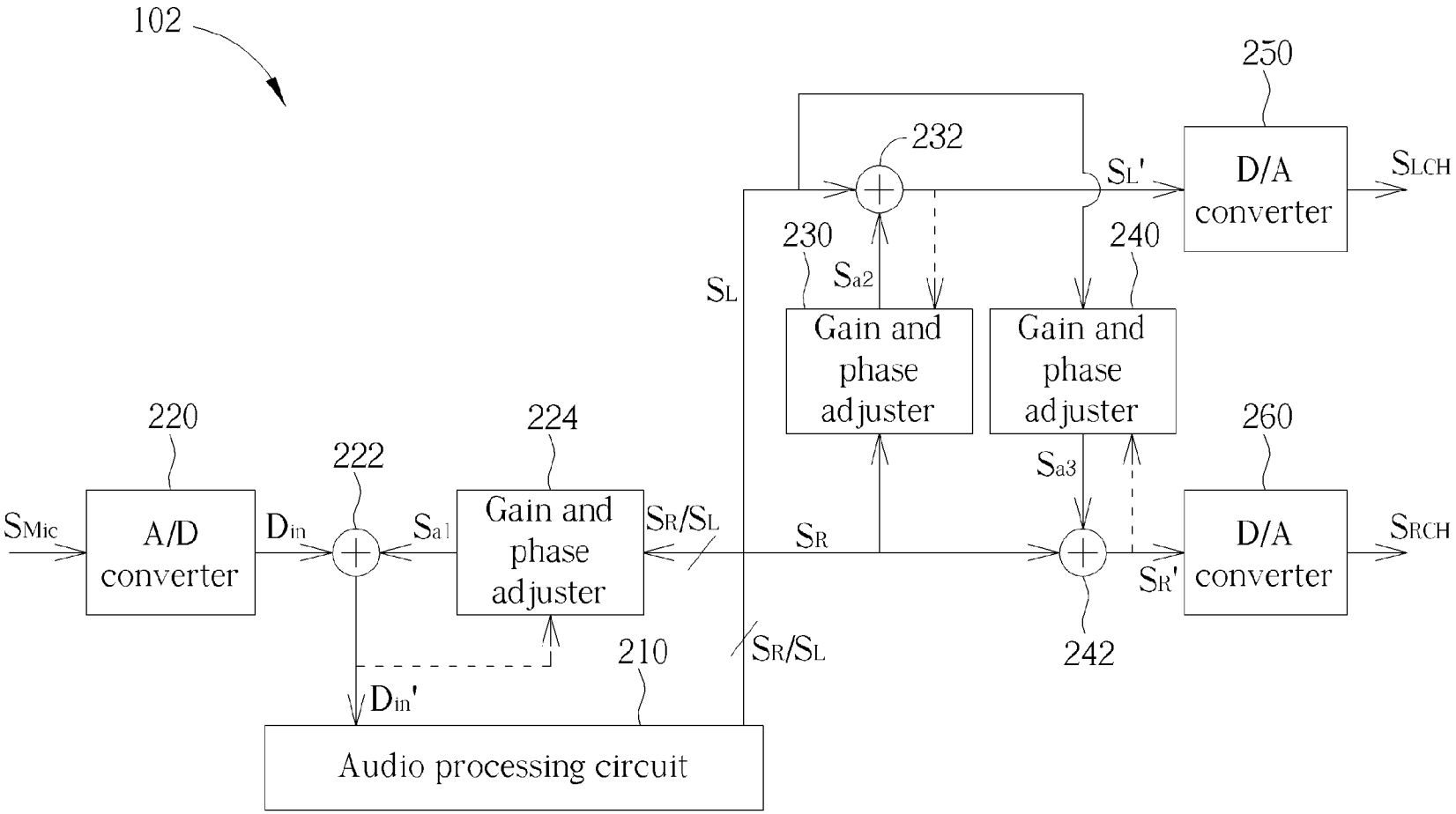
FIG. 2 is a diagram illustrating a signal processing circuit according to an embodiment of the present invention.

Please refer to FIG. 2, which is a diagram illustrating a signal processing circuit 102 according to an embodiment of the present invention. As shown in FIG. 2, the signal processing circuit 102 includes an audio processing circuit 210, an analog-to-digital (A/D) converter 220, three adders 222, 232, 242, three gain and phase adjusters 224, 230 and 240, and two digital-to-analog (D/A) converters 250 and 260.

Please refer to both FIGS. 1 and 2. In a case where the signal processing circuit 102 simultaneously picks up sounds and plays sounds, the A/D converter 220 receives the sound signal $S_{Mic}$ from the microphone 114, and performs the A/D conversion upon the sound signal $S_{Mic}$ to generate a digital input signal $D_{in}$. Meanwhile, the left channel signal $S_L$ and the right channel signal $R_L$ are transmitted to the gain and phase adjuster 224, and then the gain and phase adjuster 224 adjusts the gain and phase of each of the left channel signal $S_L$ and the right channel signal $S_R$ to generate an adjusted signal $S_{a1}$. In this embodiment, the gain and phase adjuster 224 may be utilized to generate the adjusted signal $S_{a1}$ by adjusting the gain and phase of a signal derived from summing up (combining) the left channel signal $S_L$ and the right channel signal $R_L$, or by adjusting the phases and gains of the left channel signal $S_L$ and the right channel signal $R_L$ respectively and then summing up the adjusted left channel signal and the adjusted right channel signal.

Further, the settings of the gain and phase adjuster 224 that are related to the gain adjusting amount and the phase adjusting amount may be determined by a designer or a manufacturer referring to experiment results. That is, the gain adjusting amount and the phase adjusting amount may be set by fixed values. Alternatively, the gain adjusting amount and the phase adjusting amount may be dynamically adjusted according to the change/variation of the digital input signal $D_{in}'$. The amplitude of the adjusted signal $S_{a1}$ outputted by the gain and phase adjuster 224 is similar to the amplitude of the coupling signal coupled to the connection point Mic_in as shown in FIG. 1, but would have an opposite phase.

Then, the adder 222 sums up (combines) the digital input signal $D_{in}$ and the adjusted signal $S_{a1}$ to generate an adjusted digital input signal $D_{in}'$ to the audio processing circuit 210. Since the coupling signal included in the digital input signal $D_{in}$ and the adjusted signal $S_{a1}$ have the same amplitude but opposite phases, the adjusted digital input signal $D_{in}'$ may be viewed as a clean sound signal recorded by the microphone 114, thus improving the sound recording quality of the microphone 114.

On the other hand, the gain and phase adjuster 230 adjusts the gain and phase of the right channel signal $S_R$ to generate an adjusted signal $S_{a2}$. After that, the adder 232 sums up (combines) the left channel signal $S_L$ and the adjusted signal $S_{a2}$ to generate an adjusted left channel signal $S_L'$. The adjusted left channel signal $S_L'$ is converted into a left channel audio signal $S_{LCH}$ through the D/A converter 250, and the left channel audio signal $S_{LCH}$ is transmitted to the left earphone 112_L through the connection point HPO_L of the chip 100 and the connection point L of the audio plug 116.

Further, the settings of the gain and phase adjuster 230 that are related to the gain adjusting amount and the phase adjusting amount may be determined by a designer or a manufacturer referring to experiment results. That is, the gain adjusting amount and the phase adjusting amount may be set by fixed values. Alternatively, the gain adjusting amount and the phase adjusting amount maybe dynamically adjusted according to the change/variation of the adjusted signal $S_{a2}$. The amplitude of the adjusted signal $S_{a2}$ outputted by the gain and phase adjuster 230 is similar to the amplitude of the coupling signal coupled to the left earphone 112_L as shown in FIG. 1, but would have an opposite phase.

The operation of the aforementioned gain and phase adjuster 230 and the adder 232 may be viewed as a pre-adjustment of the left channel signal $S_L$/left channel audio signal $S_{LCH}$, which makes the sound heard by the user through the left earphone 112_L similar to the contents of the left channel signal $S_L$ without being interfered with the coupling signal as shown in FIG. 1.

Similarly, the gain and phase adjuster 240 adjusts the gain and phase of the left channel signal $S_L$ to generate an adjusted signal $S_{a3}$. After that, the adder 242 sums up (combines) the right channel signal $S_R$ and the adjusted signal $S_{a3}$ to generate an adjusted right channel signal $S_R'$. Then, the adjusted right channel signal $S_R'$ is converted into a right channel audio signal $S_{RCH}$ through the D/A converter 260, and the right channel audio signal $S_{RCH}$ is transmitted to the right earphone 112_R through the connection pint HPO_R of the chip 100 and the connection point R of the audio plug 116.

Further, the settings of the gain and phase adjuster 240 that are related to the gain adjusting amount and the phase adjusting amount may be determined by a designer or a manufacturer referring to experiment results. That is, the gain adjusting amount and the phase adjusting amount may be set by fixed values. Alternatively, the gain adjusting amount and the phase adjusting amount maybe dynamically adjusted according to the change of the adjusted signal $S_{a3}$. The amplitude of the adjusted signal $S_{a3}$ outputted by the gain and phase adjuster 240 will be similar to the amplitude of the coupling signal coupled to the right earphone 112_R as shown in FIG. 1, but have an opposite phase.

The operation of the aforementioned gain and phase adjuster 240 and the adder 242 may be viewed as a pre-adjustment of the right channel signal $S_R$/right channel audio signal $S_{RCH}$, which makes the sound heard by the user through the right earphone 112_R similar to the contents of the right channel $S_R$ without being interfered with the coupling signal.

In summary, the signal processing circuit 102 of the present invention is capable of canceling the interference resulting from the coupling signal. Hence, the sound recording quality of the microphone 114 and the sound playback quality of the right earphone 112_R and the left earphone 112_L will be greatly improved.

Figure 3:
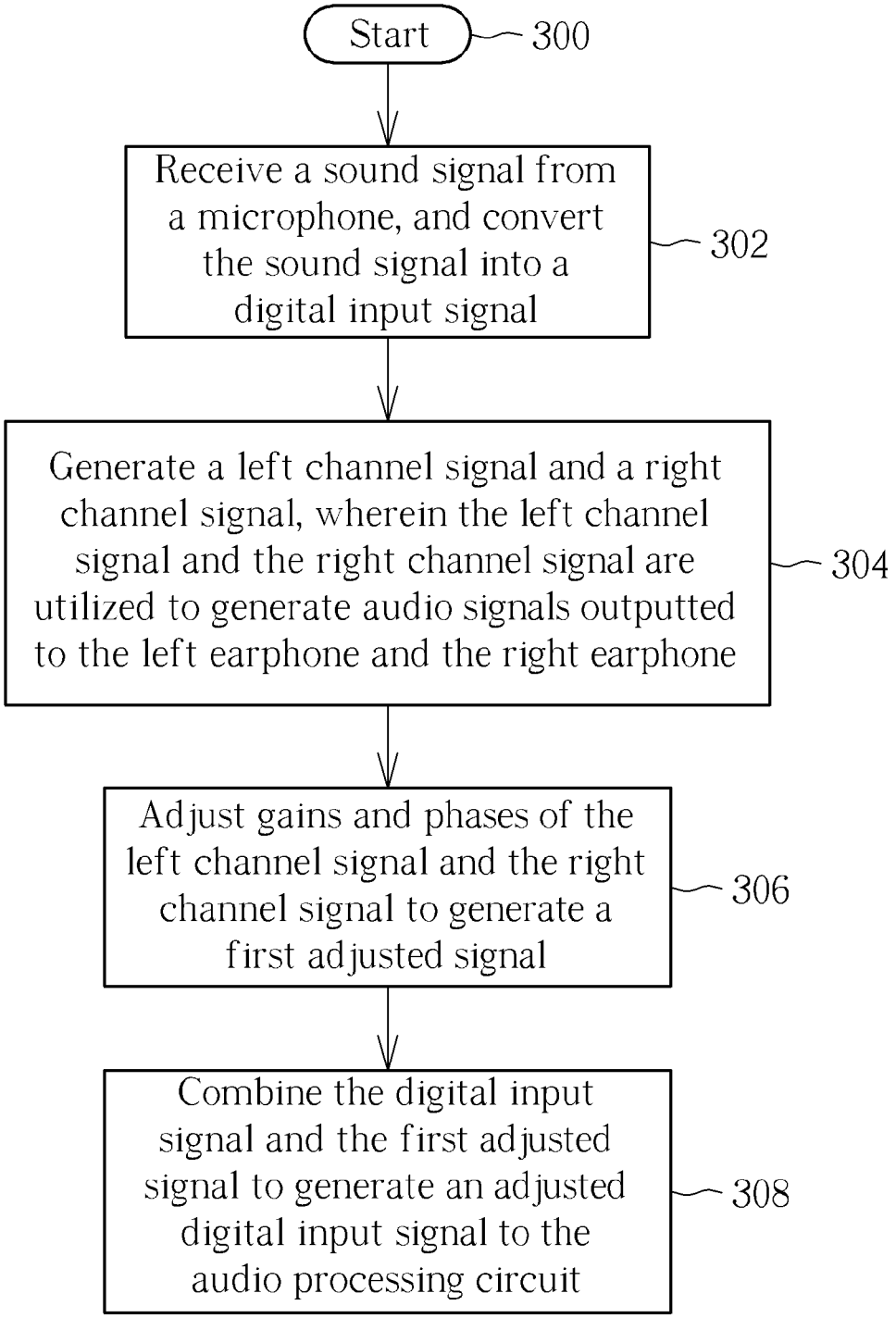
FIG. 3 is a flowchart illustrating a signal processing method according to an embodiment of the present invention.

FIG. 3 is a flowchart illustrating a signal processing method according to an embodiment of the present invention, wherein the flowchart in FIG. 3 mainly corresponds to the operations on the audio processing circuit 210, the A/D converter 200, the adder 222 and the gain and phase adjuster 224 shown in FIG. 2. Please refer to FIGS. 1-3. The signal processing method of FIG. 3 is as follows:

Step 300: Start.

Step 302: Receive a sound signal from a microphone, and convert the sound signal into a digital input signal.

Step 304: Generate a left channel signal and a right channel signal, wherein the left channel signal and the right channel signal are utilized to generate audio signals outputted to the left earphone and the right earphone.

Step 306: Adjust gains and phases of the left channel signal and the right channel signal to generate a first adjusted signal.

Step 308: Combine the digital input signal and the first adjusted signal to generate an adjusted digital input signal to the audio processing circuit.

Figure 4:
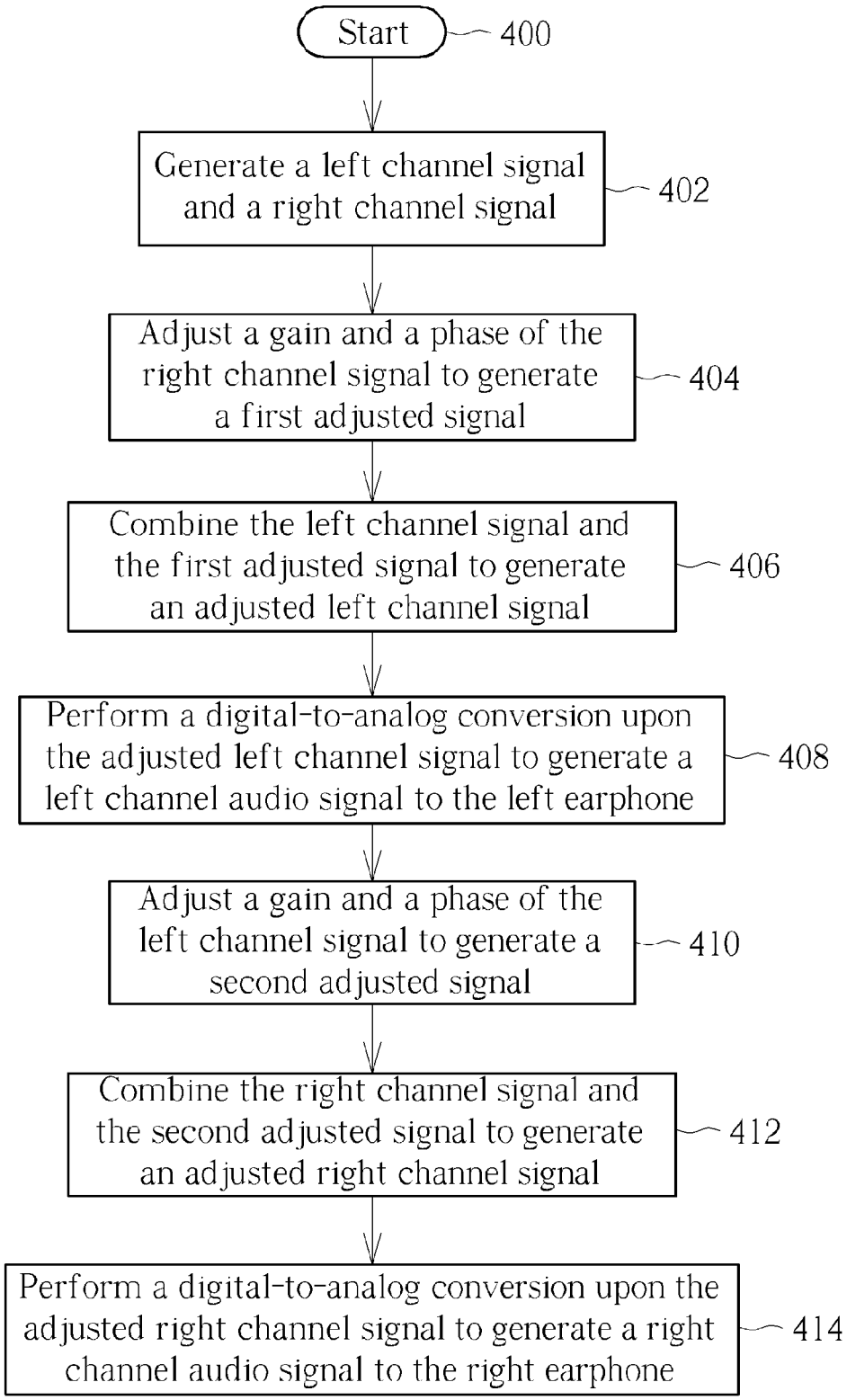
FIG. 4 is a flowchart illustrating to a signal processing method according to another embodiment of the present invention.

Please refer to FIG. 4, which is a flowchart illustrating a signal processing method according to another embodiment of the present invention, wherein the flowchart tin FIG. 4 mainly corresponds to the operations of the audio processing circuit 210, the gain and phase adjusters 230, 240, the adders 232, 242 and the D/A converters 250, 260 shown in FIG. 2. Please refer to FIGS. 1, 2 and 4. The signal processing method of FIG. 4 is as follows:

Step 400: Start.

Step 402: Generate a left channel signal and a right channel signal.

Step 404: Adjust a gain and a phase of the right channel signal to generate a first adjusted signal.

Step 406: Combine the left channel signal and the first adjusted signal to generate an adjusted left channel signal.

Step 408: Perform a digital-to-analog conversion upon the adjusted left channel signal to generate a left channel audio signal to the left earphone.

Step 410: Adjust a gain and a phase of the left channel signal to generate a second adjusted signal.

Step 412: Combine the right channel signal and the second adjusted signal to generate an adjusted right channel signal.

Step 414: Perform a digital-to-analog conversion upon the adjusted right channel signal to generate a right channel audio signal to the right earphone.

In brief, with the use of the proposed signal processing circuit and signal processing method applied to a headset according to the present invention, when there is impedance existing in the grounding point of the audio jack, the inner grounding point of the audio chip (audio IC), or the layout trace for connecting the audio jack to the audio chip, the crosstalk between the left and right channels will be avoided/mitigated, and the microphone will not simultaneously record the signals played by the earphones.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A signal processing circuit applied to a headset, wherein the headset comprises a left earphone, a right earphone and a microphone, and the signal processing circuit receives a sound signal from the microphone, and generates audio signals to the left earphone and the right earphone, respectively; the signal processing circuit comprising:

an analog-to-digital converter, arranged for receiving the sound signal from the microphone, and converting the sound signal into a digital input signal;

an audio processing circuit, arranged for generating a left channel signal and a right channel signal, wherein the left channel signal and the right channel signal are utilized to generate the audio signals;

a first gain and phase adjuster, coupled to the audio processing circuit, wherein the first gain and phase adjuster is arranged to adjust gains and phases of the left channel signal and the right channel signal to generate a first adjusted signal; and a first adder, coupled to the analog-to-digital converter, the first gain and phase adjuster, and the audio processing circuit, wherein the first adder is arranged to combine the digital input signal and the first adjusted signal to generate an adjusted digital input signal, and provide the adjusted digital input signal to the audio processing circuit.

2. The signal processing circuit of claim 1, wherein the signal processing circuit is configured in a chip, the chip is connected to an audio jack, the headset further comprises an audio plug arranged for connecting to the audio jack, and a grounding point on the audio jack is connected to a grounding point in the chip through a layout trace; a part of the audio signal is mixed to the sound signal, and the first adder is utilized to cancel the part of the audio signal in the digital input signal to generate the adjusted digital input signal.

3. The signal processing circuit of claim 1, further comprising:

a second gain and phase adjuster, coupled to the audio processing circuit, wherein the second gain and phase adjuster is arranged to adjust a gain and a phase of the right channel signal to generate a second adjusted signal;

a second adder, coupled to the second gain and phase adjuster and the audio processing circuit, wherein the second adder is arranged to combine the left channel signal and the second adjusted signal to generate an adjusted left channel signal;

a first digital-to-analog converter, coupled to the second adder, wherein the first digital-to-analog converter is arranged to perform a digital-to-analog conversion upon the adjusted left channel signal to generate a left channel audio signal in the audio signals;

a third gain and phase adjuster, coupled to the audio processing circuit, wherein the third gain and phase adjuster is arranged to adjust a gain and a phase of the left channel to generate a third adjusted signal;

a third adder, coupled to the third gain and phase adjuster and the audio processing circuit, wherein the third adder is arranged to combine the right channel signal and the third adjusted signal so as to generate an adjusted right channel signal; and a second digital-to-analog converter, coupled to the third adder, wherein the second digital-to-analog converter is arranged to perform a digital-to-analog conversion upon the adjusted right channel signal to generate a right channel audio signal in the audio signal.

4. The signal processing circuit of claim 3, wherein the signal processing circuit is configured in a chip, the chip is connected to an audio jack, the headset further comprises an audio plug arranged for connecting to the audio jack, and a grounding point on the audio jack is connected to a grounding point in the chip through a layout trace; a part of the right channel audio signal is mixed to the left channel audio signal when the right channel audio signal is transmitted to the right earphone, a part of the left channel audio signal is mixed to the right channel audio signal when the left channel audio signal is transmitted to the left earphone, the second adder is utilized to adjust the left channel signal in advance to reduce interference resulting from the right channel audio signal, and the third adder is utilized to adjust the right channel signal in advance to reduce interference resulting from the left channel audio signal.

5. A signal processing circuit applied to a headset, wherein the headset comprises a left earphone, a right earphone and a microphone, and the signal processing circuit receives a sound signal from the microphone, and generates audio signals to the left earphone and the right earphone, respectively; the signal processing circuit comprising:

an audio processing circuit, arranged for generating a left channel signal and a right channel signal;

a first gain and phase adjuster, coupled to the audio processing circuit, the first gain and phase adjuster arranged to adjust a gain and a phase of the right channel signal to generate a first adjusted signal;

a first adder, coupled to the first gain and phase adjuster and the audio processing circuit, the first adder arranged to combine the left channel signal and the first adjusted signal to generate an adjusted left channel signal;

a first digital-to-analog converter, coupled to the first adder, the first digital-to-analog converter arranged to perform a digital-to-analog conversion upon the adjusted left channel signal to generate a left channel audio signal in the audio signals;

a second gain and phase adjuster, coupled to the audio processing circuit, the second gain and phase adjuster arranged to adjust a gain and a phase of the left channel signal to generate a second adjusted signal;

a second adder, coupled to the second gain and phase adjuster and the audio processing circuit, the second adder arranged to combine the right channel signal and the second adjusted signal to generate an adjusted right channel signal; and a second digital-to-analog converter, coupled to the second adder, the second digital-to-analog converter arranged to perform a digital-to-analog conversion upon the adjusted right channel signal to generate a right channel audio signal in the audio signals.

6. The signal processing circuit of claim 5, wherein the signal processing circuit is configured in a chip, the chip is connected to an audio jack, the headset further comprises an audio plug arranged for connecting to the audio jack, and a grounding point on the audio jack is connected to a grounding point in the chip through a layout trace; a part of the right channel audio signal is mixed to the left channel audio signal when the right channel audio signal is transmitted to the right earphone, a part of the left channel audio signal is mixed to the right channel audio signal when the left channel audio signal is transmitted to the left earphone, the first adder is utilized to adjust the left channel signal in advance to reduce interference resulting from the right channel audio signal, and the second adder is utilized to adjust the right channel signal in advance to reduce interference resulting from the left channel audio signal.

7. A signal processing method applied to a headset, wherein the headset comprises a left earphone, a right earphone and a microphone, the signal processing method comprising:

receiving a sound signal from the microphone, and converting the sound signal into a digital input signal;

generating a left channel signal and a right channel signal, wherein the left channel signal and the right channel signal are utilized to generate audio signals outputted to the left earphone and the right earphone, respectively;

adjusting gains and phases of the left channel signal and the right channel signal, to generate a first adjusted signal; and combining the digital input signal and the first adjusted signal, to generate an adjusted digital input signal.

8. The signal processing method of claim 7, wherein the signal processing method of is performed by a circuit configured in a chip, the chip is connected to an audio jack, the headset further comprises an audio plug arranged for connecting to the audio jack, and a grounding point on the audio jack is connected to a grounding point in the chip through a layout trace; a part of the audio signal is mixed to the sound signal, and the adjusted digital input signal is utilized to cancel the part of the digital input signal.

9. The signal processing method of claim 7, further comprising:

adjusting a gain and a phase of the right channel signal, to generate a second adjusted signal;

combining the left channel signal and the second adjusted signal, to generate an adjusted left channel signal;

performing a digital-to-analog conversion upon the adjusted left channel signal, to generate a left channel audio signal in the audio signals;

adjusting a gain and a phase of the left channel, to generate a third adjusted signal;

combining the right channel signal and the third adjusted signal, to generate an adjusted right channel signal; and performing a digital-to-analog conversion upon the adjusted right channel signal, to generate a right channel audio signal in the audio signal.

10. The signal processing method of claim 9, wherein the signal processing method is performed by a circuit configured in a chip, the chip is connected to an audio jack, the headset further comprises an audio plug arranged for connecting to the audio jack, and a grounding point on the audio jack is connected to a grounding point in the chip through a layout trace; a part of the right channel audio signal is mixed to the left channel audio signal when the right channel audio signal is transmitted to the right earphone, a part of the left channel audio signal is mixed to the right channel audio signal when the left channel audio signal is transmitted to the left earphone, and the step of generating the adjusted left channel signal is utilized to avoid interference resulting from the right channel audio signal in advance, and the step of generating the adjusted right channel signal is utilized to avoid interference resulting from the left channel audio signal in advance.

11. A signal processing method applied to a headset, wherein the headset comprises a left earphone, a right earphone and a microphone, the signal processing method comprising:

generating a left channel signal and a right channel signal;

adjusting a gain and a phase of the right channel signal, to generate a first adjusted signal;

combining the left channel signal and the first adjusted signal, to generate an adjusted left channel signal;

performing a digital-to-analog conversion upon the adjusted left channel signal, to generate a left channel audio signal to the left earphone;

adjusting a gain and a phase of the left channel signal, to generate a second adjusted signal;

combining the right channel signal and the second adjusted signal, to generate an adjusted right channel signal; and performing a digital-to-analog conversion upon the adjusted right channel signal, to generate a right channel audio signal to the right earphone.

12. The signal processing method of claim 11, wherein the signal processing method performed by a circuit in a chip, the chip is connected to an audio jack, the headset further comprises an audio plug arranged for coupling to the audio jack, and a grounding point on the audio jack is connected to a grounding point in the chip through a layout trace; a part of the right channel audio signal is mixed to the left channel audio signal when the right channel audio signal is transmitted to the right earphone, a part of the left channel audio signal is mixed to the right channel audio signal when the left channel audio signal is transmitted to the left earphone, the step of generating the adjusted left channel signal is utilized to avoid interference resulting from of the right channel audio signal in advance, and the step of generating the adjusted right channel signal is utilized to avoid interference resulting from the left channel audio signal in advance.

* * * * *